United States Patent [19]

Menn et al.

[11] Patent Number: 4,924,144

[45] **Date of Patent: * May 8, 1990**

[54] MATRIX SCREEN, ITS PRODUCTION PROCESS AND MATRIX DISPLAY MEANS WITH SEVERAL TONES, CONTROLLED ON AN ALL OR NOTHING BASIS AND INCORPORATING SAID SCREEN

[76] Inventors: Roger Menn, 17 Rue Latour Prolongee, 60140 Liancourt; Christian Brunel, 5 Rue Mouere, 92120 Montrouge; Dario Pecile, 59 rue de lu Bourgogue, 95430 Auders // Oise, all of France

[ * ] Notice: The portion of the term of this patent subsequent to Oct. 17, 2006 has been disclaimed.

[21] Appl. No.: 853,170

[22] Filed: Apr. 17, 1986

[30] Foreign Application Priority Data

Apr. 17, 1985 [FR] France ..... 85 05798

[51] Int. Cl.[5] ..... H01J 1/68; H01J 17/70

[52] U.S. Cl. ..... 313/505; 313/500; 313/506; 313/509; 315/169.3; 340/752; 340/754; 340/760

[58] Field of Search ..... 313/505, 506, 509, 169.3, 313/500, 502; 340/752, 754, 760

[56] References Cited

U.S. PATENT DOCUMENTS

| | | | |
|---|---|---|---|
| 3,258,628 | 6/1966 | Acton | 313/505 |
| 4,006,383 | 2/1977 | Luo et al. | 313/509 |
| 4,013,166 | 3/1977 | Oshima et al. | 313/509 |
| 4,388,559 | 6/1983 | Suntola et al. | 313/505 |
| 4,449,125 | 5/1984 | Clerc et al. | 340/784 |

FOREIGN PATENT DOCUMENTS 2489023 2/1982 France .

*Primary Examiner*—Donald J. Yusko
*Assistant Examiner*—Michael Horabik
*Attorney, Agent, or Firm*—Oblon, Spivak, McClelland, Maier & Neustadt

[57] ABSTRACT

Matrix screen, its production process and matrix display means with several tones, controlled on an all or nothing basis and incorporating said screen. The screen has electroluminescent zones distributed in matrix-like manner and placed between crossing row electrodes and column electrodes, each row electrode being formed from m first parallel conductive strips of different widths and each column electrode being formed from n second parallel conductive strips of different widths, m and n being positive integers, whereof at least one is 2. The electroluminescent zones are defined by the intersection of the first and second conductive strips. Application to half-tone display using electrical addressing circuits operating on an all or nothing basis.

9 Claims, 7 Drawing Sheets

MATRIX SCREEN, ITS PRODUCTION PROCESS AND MATRIX DISPLAY MEANS WITH SEVERAL TONES, CONTROLLED ON AN ALL OR NOTHING BASIS AND INCORPORATING SAID SCREEN

BACKGROUND OF THE INVENTION

The present invention relates to a matrix screen, its production process and a matrix display means with several tones, controlled on an all or nothing basis and incorporating such a screen. It is used in optoelectronics and particularly in the analogue display of complex images or in the display of alphanumeric characters, said displays being either monochrome or polychrome.

Information processing and telematic consoles, such as for example electronic telephone directories and microcomputers are becoming objects of everyday life. Most of these equipments which are presently available are equipped with cathode ray display tubes. However, other display means, such as e.g. flat matrix screens are increasingly replacing the cathode ray tubes, which are heavy, cumbersome and visually uncomfortable. Some of these flat screens display the formation of imagess and diagrams in several tints and even in color.

The invention more particularly relates to a flat matrix screen constituted by a material having optical properties which can be electrically modified, which is placed between a first group of p row electrodes formed from parallel conductive strips and a second group of q column electrodes formed from parallel conductive strips. The row and column electrodes cross one another, so that an image point $x_{ij}$ of the screen is defined by the overlap region of one row electrode i and one column electrode j, in which i and j are integers such that $1 \leqq i \leqq p$ and $1 \leqq j \leqq q$. Means for supplying electrical signals on each electrode are provided in order to electrically modify the optical property of the material, in accordance with two different states. Numerous flat matrix screens of this type are known, which use as the sensitive material an electroluminescent material. This material is compatible with the display in half-tones or several tones, as well as colour displays. Such matrix screens are more particularly described in an article in IEEE Transactions on Electron Devices, vol ED-30, No 5, May 1983, pp 460–463 entitled "Thin Film Electroluminescent Devices: Influence of Mn-Doping Method and Degradation Phenomena".

Although the invention more particularly applies to such matrix screens, it also applies in more general terms to all display screens having a material, whereof one optical property can be modified with the aid of an electrical excitation. This material can be solid or liquid, amorphous or crystalline. The optical property can be an opacity, refractive index, transparency, absorption, diffusion, diffraction, convergence, rotary power, birefringence, intensity reflected in a given solid angle, etc.

The generally used electroluminescent matrix screens operate on all or nothing basis, i.e. they only permit a display in two tones, e.g. black and white. Such a matrix screen is more particularly described in FR-A-2 489 023. Their advantage is the use of relatively simple control or addressing integrated circuits.

In order to permit a display in several tones or half-tones, e.g. different grey tones, various electronic processes have been envisaged. These processes based on the application of different electrical signals as a function of the half-tone which it is wished to obtain, require the production of relatively complex integrated control circuits, whose cost, related to a column electrode of the matrix screen, is six times higher than the cost of a control operating on an all or nothing basis. In view of the number of row electrodes and column electrodes, the total cost of control circuits is prohibitive.

SUMMARY OF THE INVENTION

The object of the present invention is a matrix screen, particularly an electroluminescent screen permitting, for the eye, a display according to a linear scale of half-tones or tones of a same colour, so that the aforementioned disadvantages can be obviated. It more particularly makes it possible to use integrated addressing or control circuits for the screen provided for an all or nothing operation (economic advantages), whilst enabling the elements of the matrix to operate with a single exciting voltage (screens construction easier).

More specifically the present invention relates to a matrix screen incorporating a layer of material having electrooptical properties, placed between p parallel row electrodes and q parallel column electrodes, the row electrodes and column electrodes crossing one another, an image point $x_{ij}$ of the screen being defined by the region of the electrooptical material covered by the row electrode i and column electrode j, in which i and j are integers such that $1 \leqq i \leqq p$ and $1 \leqq j \leqq q$, wherein each row electrode is formed from m first parallel conductive strips of different widths and each column electrode is formed from n second parallel conductive strips of different widths, m and n being positive integers, whereof at least one is $\geqq 2$ and wherein the material layer is cut over its entire thickness into several zones distributed in matrix-like manner, said zones being defined by the intersection of said first and second conductive strips.

In other words, at each intersection of a first conductive strip of the column electrodes and a second conductive strip of the row electrodes there is an electrooptical material zone, which exactly coincides with the overlap surface of the corresponding first and second conductive strips.

The use of row electrodes and column electrodes, each formed from parallel conductive strips has in particular been described in the aforementioned FR-A 2 489 023. However, this cutting up of the electrodes was used for reducing the effects due to structural defects of the electroluminescent material and not for the purpose of a multiple half-tone display.

According to a preferred embodiment, the p row electrodes have an identical structure. In the same way, the q column electrodes have an identical structure, which may or may not be the same as that of the row electrodes.

Advantageously, the electrooptical material layer is formed from $k \geqq 2$ materials in the solid state having different electroluminescent properties, k being a positive integer. In particular, when $k=2$, both these materials can be zinc sulfide doped with $Mn^{2+}$ ions, the doping agent quantity and/or the thickness of these materials being different.

Advantageously, the case $k \geqq 2$ materials are separated from one another by a dielectric material.

The particular subdivision of the material layer having electrooptical properties, as well as the use of materials having electrooptical properties, particularly electroluminescent properties of different types makes it possible to produce a matrix display with several colour tones or half-tones, whilst using integrated addressing or control circuits for the said electrooptical material layer operating on an all or nothing basis.

The invention also relates to a matrix display means with several tones comprising a matrix screen of type described hereinbefore, together with means for independently applying to the conductive strips of each row electrode and each column electrode, electrical signals used for controlling on an all or nothing basis the electrooptical property of the material layer.

The present invention also relates to a process for the production of a matrix screen of the type described hereinbefore. Thus, the invention relates to a process, wherein electrooptical material zones are produced, which are distributed in matrix-like manner and which are separated from one another by a dielectric material, between a first group of p parallel electrodes, each formed from m first parallel conductive strips of different widths and a second group of q parallel electrodes, each formed from second parallel conductive strips of different widths, m and n being positive integers, whereof at least one is $\geqq 2$, the electrodes of the first group and the electrodes of the second group crossing one another, the electrooptical material zones being defined by the intersection zones of the first and second conductive strips, an image input $x_{ij}$ of the screen being defined by the intersection of an electrode i of the first group and an electrode j of the second group, i and j being integers such that $1 \leqq i \leqq p$ and $1 \leqq j \leqq q$.

The production process for a matrix screen according to the invention is constituted by a succession of relatively simple operations.

According to a preferred embodiment of the inventive process, the following stages are performed:

(a) producing one of said two electrode groups on a substrate, (b) depositing a layer of determined thickness of a first dielectric material, (c) producing in said first dielectric material, layer at least one first opening at each intersection of an electrode of the first group and one electrode of the second group, said first openings being made facing one of the first conductive strips of each electrode of the first group and one of the second conductive strips of each electrode of the second group, (d) partial filling of said first openings with a first electroluminescent solid material, (e) covering the first electroluminescent material with a second dielectric material in order to completely fill said first openings, (f) producing in said layer of first dielectric material at least one second opening at each intersection of an electrode of the first group and an electrode of the second group, said second openings being made facing other first and second conductive strips, (g) partial filling of said second openings by a second solid electroluminescent material having an electroluminescent property different from the one of said first electroluminescent material, (h) covering said second electroluminescent solid material with a third dielectric material in order to completely fill said second openings and (i) producing the other group of electrodes.

Advantageously, m and n are at the most equal to 2. In particular, m can be equal to 1 and n to 2 and conversely m can be equal to 2 and n to 1. This makes it possible to obtain 4 half-tones or tones. In the same way, m and n can both be taken as equal to 2, which makes it possible to obtain a display with 8 tones or half-tones. Moreover, the values of m and n determine the maximum number of electroluminescent materials which can be used, said number being defined by the product m.n.

Obviously, m and n can assume much higher values, but the economic interest is liable to decrease as m and n increase, because the number of electrical accesses to the different image points of the matrix increases in proportion thereto.

The use of two materials having different electrooptical properties and in particular different electroluminescent properties makes a considerable contribution to obtaining a display in several tones or half-tones of a same colour.

Advantageously, the first and/or second openings are formed in the first material layer by depositing thereon a resin mask, representing the image of said openings, i. e. being used for defining their dimensions and locations, followed by etching said first material. With such an etching process, the first and/or second openings are then filled with the corresponding electrooptical material by depositing on the body of the structure a layer of said material, said layer having a thickness below that of the first material layer. A dielectric material layer is then deposited on the electrooptical material. The resin mask is then eliminated. This technology, known as lift-off ensures that electrooptical material, covered with the corresponding dielectrical material is only retained within the first and/or second openings, so that a substantially planar structure is obtained.

Advantageously, between the first group of electrodes and the first dielectric material layer is placed a layer of a fourth dielectric material making it possible to ensure an electrical protection of the electrooptical material layer. In the same way, in order to increase the flatness of the structure, if this is necessary, between the second group of electrodes and the second and third dielectric material layers is placed a layer of a fifth dielectric material.

For reasons of clarity, the description refers to a matrix screen, whose electrooptical material is solid and has electroluminescent properties. However, as stated hereinbefore, the invention has a much more general application.

BRIEF DESCRIPTION OF THE DRAWINGS

The invention is described in greater detail hereinafter relative to non-limitative embodiments and the attached drawings, wherein show.

DETAILED DESCRIPTION OF THE PREFERRED EMBODIMENTS

Figure 1:
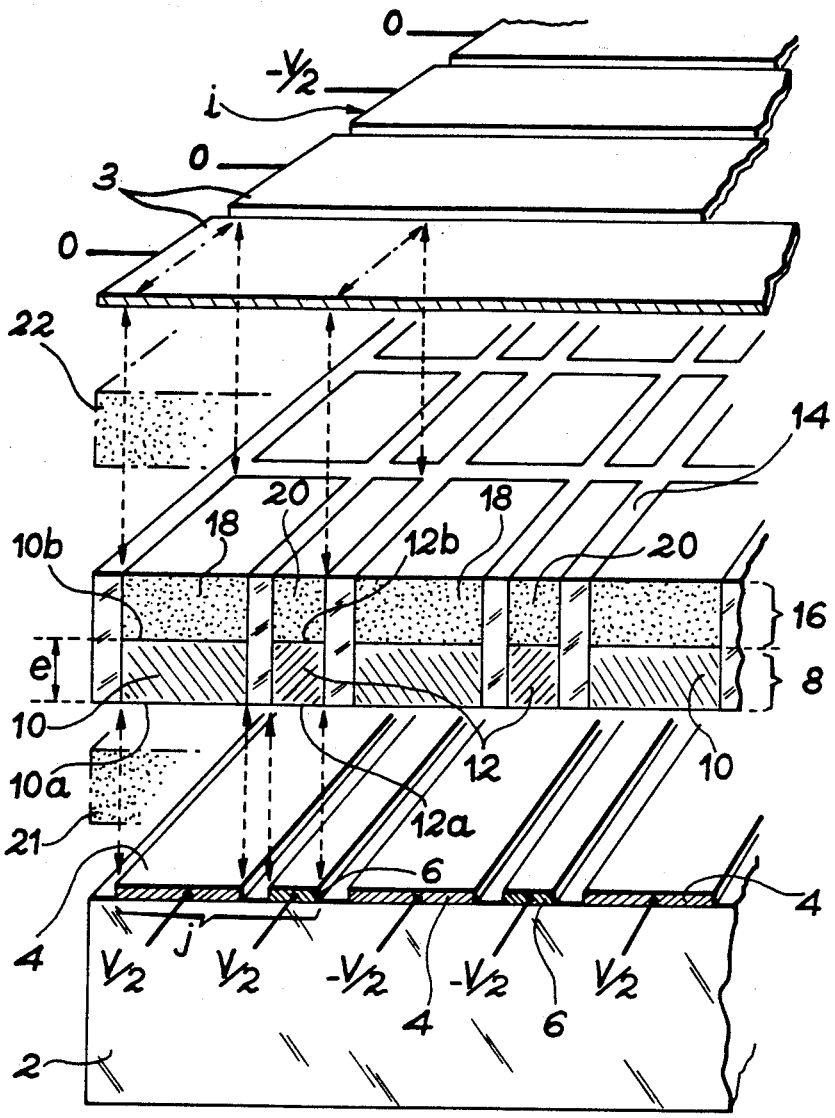
FIG. 1 diagrammatically in exploded perspective form, a matrix display means incorporating a matrix screen according to the invention.

As shown in FIG. 1, the matrix screen according to the invention comprises a transparent insulating substrate 2, e.g. made from glass. Substrate 2 forms the front face of the matrix screen. On the rear face of the screen is provided a first group of p parallel electrodes i, serving e.g. as row electrodes. Each of the latter is constituted by m parallel conductive strips 3 having different widths. In the case shown, m is equal to 1. These electrodes are made from a metallic material and in particular aluminum.

Above substrate 2 is provided a second group of q parallel electrodes j, which serve as the column electrodes, when electrodes 1 serve as the row electrodes and vice versa. Each of the electrodes j is formed from n parallel conductive strips of different widths. In the represented case, each column electrode j is formed from two conductive strips 4 and 6. Electrodes j are transparent and can be made from $In_2O_3$, $SnO_2$ or an oxide of indium and tin, known as I.T.O. The conductive strips forming the row electrodes i and those forming the column electrodes j are perpendicular.

Figure 2:
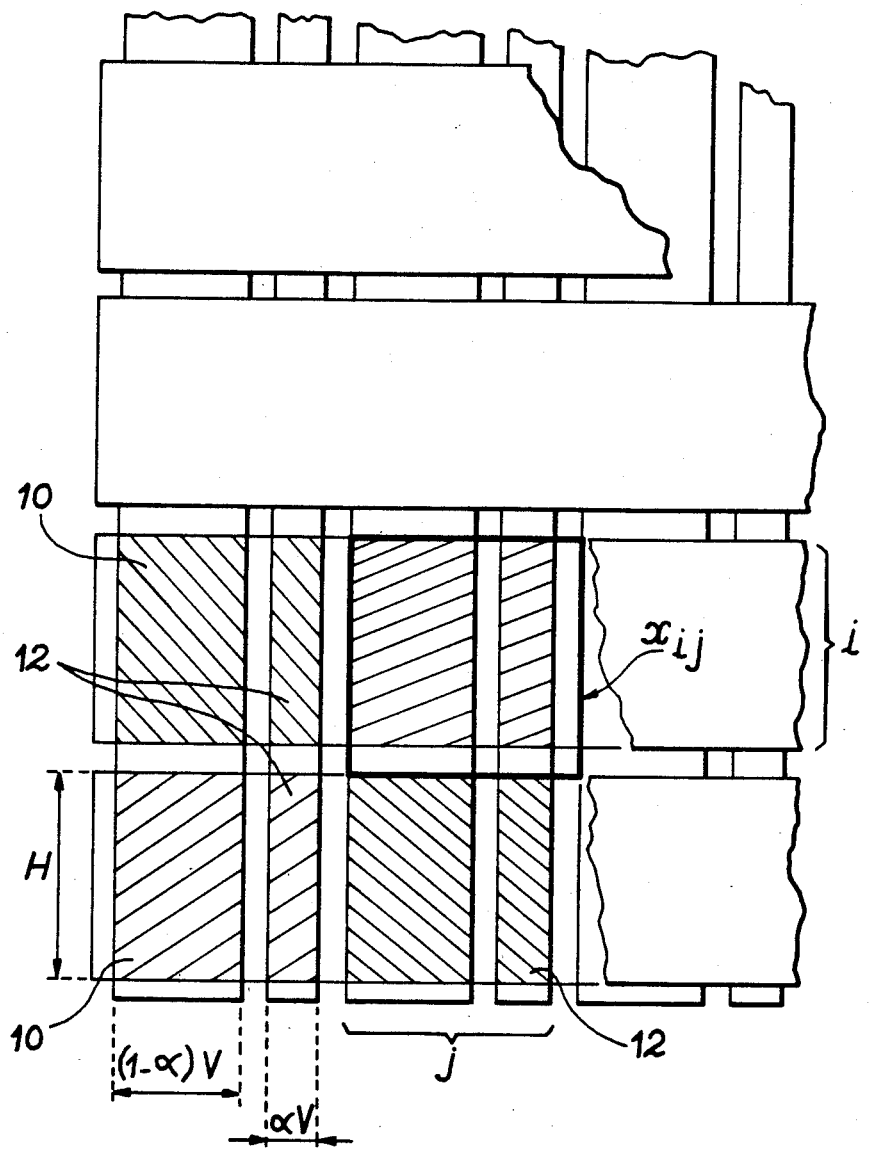
FIG. 2 diagrammatically and in plan view the intersection of the row electrodes and column electrodes of the screen of FIG. 1.

Between the row electrodes i and the column electrodes j is placed a solid layer 8 having electroluminescent properties. The useful surface of layer 8, as shown in FIG. 2, is broken down into a mosaic of image points $x_{ij}$ corresponding to the overlap zones of a row electrode i and a column electrode j. In order to obtain identical elementary image points $x_{ij}$, the row electrodes can be identical. This also applies to the column electrodes. However, there is no reason for not using different row electrodes and/or different column electrodes.

As shown in FIGS. 1 and 2 and with 1 and 2 applying respectively for m and n, layer 8 has electroluminescent properties and consequently the image points $x_{ij}$ are formed from two types of zones 10, 12 respectively distributed in matrix manner. The electroluminescent zones 10 are located facing the conductive strips 4 of the column electrodes and electroluminescent zones 12 are located facing the conductive strips 6 of the column electrodes (FIG. 2).

These two types of zone 10, 12 are in particular in the form of a rectangular parallelepiped of thickness e. The two faces respectively 10*a*, 10*b* and 12*a*, 12*b* oriented parallel to electrodes i and j of the matrix screen have a surface equal to the corresponding crossing or intersection surface of the conductive strips forming the row electrodes and the column electrodes. In particular, the faces 10*a*, 10*b* of each electroluminescent material zone 10 precisely coincide with the overlap zone of the conductive strip 4 of a column electrode j and the single conductive strip 3 constituting a row electrode i (FIG. 2). In the same way, faces 12*a*, 12*b* of each electroluminescent material zone 12 exactly coincide with the overlap zone of the conductive strip 6 of a column electrode j and the single conductive strip 3 constituting a row electrode i.

As a function of the envisaged application, the electroluminescent materials respective forming zones 10 and 12 can be identical or different. In the same way, the thickness e of these materials can be the same or different. The electroluminescent material can be Mn-doped ZnS, a material emitting in the yellow, $TbF_3$-doped ZnS, a material emitting in the green, or $CeF_3$-doped SrS, a material emitting in the blue. Preferably, the material forming the electroluminescent zones 10 is manganese-doped zinc sulfide with a manganese concentration of 3 to 3.5 mole %, whilst that constituting the electroluminescent zones 12 is manganese-doped zinc sulfide with a manganese concentration of 1.5 mole %, said two materials having the same thickness e.

As shown in FIG. 1, the two different zones 10 and 12 can be separated from one another by a dielectric material 14, which can e.g. be $TiO_2$, $Ta_2O_5$, $Si_3N_4$, $Al_2O_3$, $SiO_2$, $Y_2O_3$, etc. Preferably, dielectric material 14 is $Y_2O_3$.

Advantageously the electroluminescent layer 8 is covered with a dielectric material layer 16 cut in accordance with the same configuration as that of the electroluminescent layer. Thus, the electroluminescent zones 10 are in each case covered with a dielectric zone 18 and the electroluminescent zones 12 are each covered with a dielectric zone 20. These dielectric zones 18, 20 can be produced with the aid of the same dielectric material, or with the aid of two different dielectric materials. For example, zones 18 and 20 can be made from $Ta_2O_5$, $Y_2O_3$, $Al_2O_3$, $Si_3N_4$, $ZrO_2$, $SiO_2$, etc. Preferably, zones 18 and 20 are made from $Ta_2O_5$.

As shown in FIG. 1, a uniform layer 21 of a dielectric material can be placed between the electroluminescent material layer 8 and the column electrodes j. In the same way, a uniform layer 22 of a dielectric material can be placed between the row electrodes i and the dielectric zones 18, 20. These layers 21, 22 can be made from the same or a different dielectric material to that forming dielectric zones 18, 20. In particular, these two layers 21, 22 can be made from $Ta_2O_5$, $TiO_2$, $Y_2O_3$, $Al_2O_3$, $ZrO_2$, $Si_3N_4$, $SiO_2$, etc. Preferably, these two layers 21, 22 are made from $Ta_2O_5$.

Figure 3A:
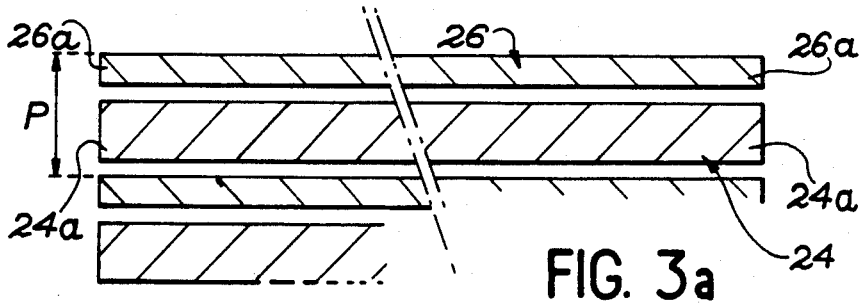
FIGS. 3*a* to 3*d* diagrammatically and in plan view, the ends of the electrodes of the matrix screen of FIG. 1.
Figure 3B:
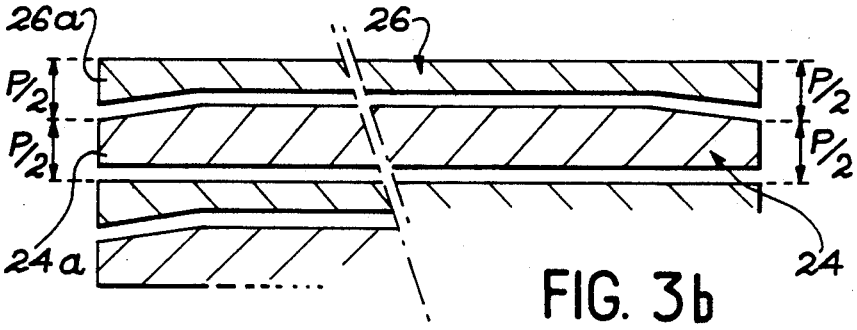
Figure 3C:
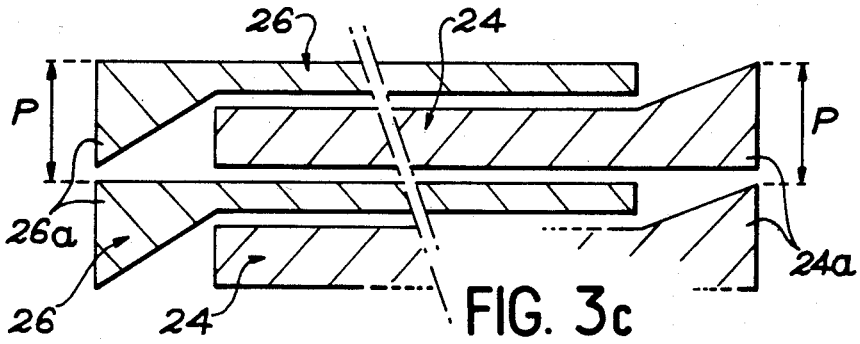

FIGS. 3*a* to 3*c* show in plan view, the different possible forms of the ends of the row electrodes and/or column electrodes of the matrix screen in the particular case where each of these electrodes is formed from two conductive strips, respectively 24, 26 having different widths. These row or column electrodes have a periodic structure, p representing the spacing of said structure e.g. being 0.35 $\mu$m.

As shown in FIG. 3*a*, the ends 24*a*, 26*a* of conductive strips 24, 26 of the same electrode can retain the same shape as the corresponding material of the conductive strips and e.g. that of a constant width strip. In this case, ends 24*a*, 26*a* of conductive strips 24, 26 are consequently asymmetrical. For a simultaneous control of the two strips 24, 26 of the same electrode, the asymmetrical shape of the ends of said strips requires the use of asymmetrical connectors for connecting said electrodes to the matrix screen control means.

Figure 3D:
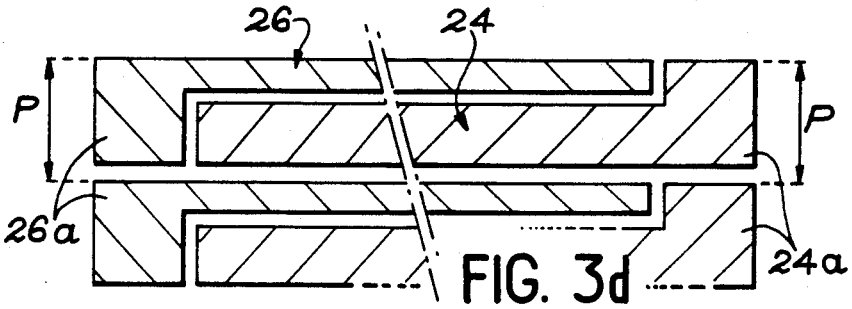

Conversely, as shown in FIGS. 3*b* to 3*d*, the ends 24*a*, 26*a* of the corresponding conductive strips 24, 26 can have a different shape from that of the material of said strips.

In particular, ends 24*a*, 26*a* can be in the form of a variable width strip, thus making it possible to obtain symmetrical ends of resolution P/2 or resolution p, as respectively shown in FIGS. 3*b* and 3*c*. In FIG. 3*b*, in the plane of said drawing, the ends 24*a*, 26*a* of the conductive strips have the form of a trapezium with two perpendicular sides and in FIG. 3*c*, in the plane of said drawing, the form of a trapezium with three perpendicular sides.

The ends 24*a*, 26*a* of the conductive strips can also be in the form of a block with a greater width than that of the corresponding conductive strip and as shown in FIG. 3*d*; the resolution of the ends being P.

The aforementioned electroluminescent matrix screen permits a display with several tones or half-tones using integrated circuits for controlling the electroluminescent properties of electroluminescent layer 8 and consequently electroluminescent zones 10, 12, provided for functioning on an all or nothing basis. A display can be obtained by applying in an independent manner to the m conductive strips of each row electrode and to the n conductive strips of each column electrode appropriate electrical signals. Advantageously, the different electroluminescent zones 10, 12 of the matrix screen can be operated by using the same exciting voltage.

In a conventional manner, the screen can be controlled by e.g. applying to row i a potential $-V/2$ and simultaneously to the columns either a potential $V/2$, for the displayed image point $x_{ij}$, or a potential $-V/2$ for the non-displayed image point $x_{ij}$ and by applying a zero potential to the other rows. The image points between row i and the columns are then exposed to a voltage V or zero and the other image points to a voltage $V/2$ inadequate for permitting the display thereof. Advantageously the potentials applied to the terminals of image points $x_{ij}$ are alternating signals with a zero mean value.

According to the invention, each elementary display point $x_{ij}$, defined by the intersection of a row electrode i and a column electrode j, is divided into m.n zones of different surfaces, e.g. two, as shown in FIG. 2. In the latter, the hatched part of an elementary display point $x_{ij}$ represents the active zone thereof, i.e. the zone having electroluminescent properties, whilst the non-hatched part represents the non-active zone of said image point.

Moreover, V represents the "vertical" width of the active zone of image point $x_{ij}$ and H the "horizontal" width of said zone. In the case where the active zone of the image point is formed from two different electroluminescent zones 10, 12, $\alpha V$ is called the "vertical" width of the electroluminescent zone 12 and $(1-\alpha)V$ the "vertical" width of the other electroluminescent zone 10.

Moreover, $\gamma$ is called the ratio of the luminescence of the electroluminescent zone 10 to the luminescence of the electroluminescent zone 12, the luminescence of said zones being determined by applying the same nominal voltage to the terminals of said zones.

This luminescence ratio $\gamma$ can be modified in different ways, e.g. by using the same electroluminescent materials, but having different thicknesses, by varying the doping of the luminophor (e.g. $Mn^{2+}$) of said materials and keeping a constant thickness, by combining both of these (different doping and thickness), or by subjecting said two materials to a different heat treatment during or after their deposition during the manufacture of the matrix screen. The influence of the heat treatment on the luminescence of ZnS:Mn is more particularly described in an article entitled "Electroluminescent flat screens with capacitive coupling: importance and study of the dielectric layer", which was published in Le Vide, Les Couches Minces, 222, May-June-July 1984, pp 205 to 212.

By taking $L_O$, the luminance obtained for a light, e.g. white point, a coefficient $\alpha$ equal to $\frac{1}{3}$ and a luminescence ratio $\gamma$ equal to 1, it is possible to obtain when using the screen according to the invention, four tones or half-tones for two electroluminescent zones per image point. The first tone, which is the darkest, e.g. black, has a zero luminance, the second tone, which is slightly lighter, a luminance equal to $\frac{1}{3}$ of $L_OHV$, the third still lighter tone, a luminance equal to $\frac{2}{3}$ of $L_OHV$ and the fourth tone, corresponding to white, a luminance equal to $L_OHV$. In a specific case, H and V can be equal to 250 $\mu$m and $L_O$ equal to 100 cd per $m^2$. The same result can be obtained by taking $\alpha$ as equal to 0.5 and $\gamma$ equal to 3.

By using row electrodes and column electrodes formed in each case from two conductive strips of different widths, it is possible to obtain eight luminance levels, which can be seen by the eye in the form of clearly defined tones or half-tones.

As a first approximation, knowing that the sensation perceived by the eye is proportional to the logarithm of the luminous excitation received by it, it is possible to choose a geometrical progression law of progression ratio $\rho$. Thus, knowing the contrast C which can be supplied by the screen, C being the ratio between the luminescence of the bright colour, such as white and that of the dark colour, such as black, the ratio $\rho$ between two consecutive tones or half-tones is given by:

$$P = \exp\left(\frac{\log C}{n-1}\right) \text{i.e. } \rho = \sqrt[n-1]{C}$$

in which n represents the number of luminescence levels and consequently the desired tones. Thus, for contrasts C varying from 10 to 50, it is possible to obtain with m and n equal to two, eight half-tones with $1.39 \leqq \rho \leqq 1.75$.

Obviously, the aforementioned law can, for economic or other reasons, be replaced by other half-tone progression laws. For example, it is possible to stage the different luminance levels representing respectively 100% of C, 90% of C, 80% of C, 70% of C, 60% of C, 50% of C and 40% of C, if C represents the maximum contrast between the bright colour (white) and the dark colour (black).

A description will now be given with reference to FIGS. 4 to 12 to a particularly original process for producing the aforementioned electroluminescent matrix screen.

Figure 4:
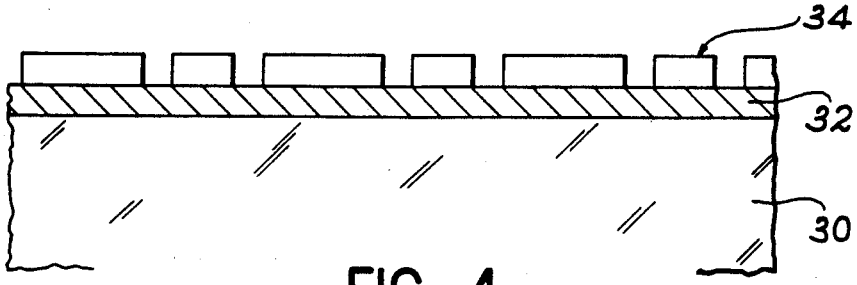
FIGS. 4 to 12 diagrammatically and in longitudinal section, the different stages of the process for producing a matrix screen according to the invention.

As shown in FIG. 4, the first stages of the process consist of producing one of the two groups of row or column electrodes on an in particular glass substrate 30. This is brought about by depositing a transparent conductive layer 32, more particularly of $In_2O_3$, $SnO_2$ or I.T.O., e.g. by vapour phase chemical deposition assisted or unassisted by plasma and then etching said layer 32 through a resin mask 34 representing the image of the electrodes to be produced, i.e. being used for defining the shape and location of these electrodes. This etching can be carried out anisotropically by the dry method (reactive ionic etching or reverse cathodic sputtering) or by the wet method, e.g. by simple chemical etching.

Figure 5:
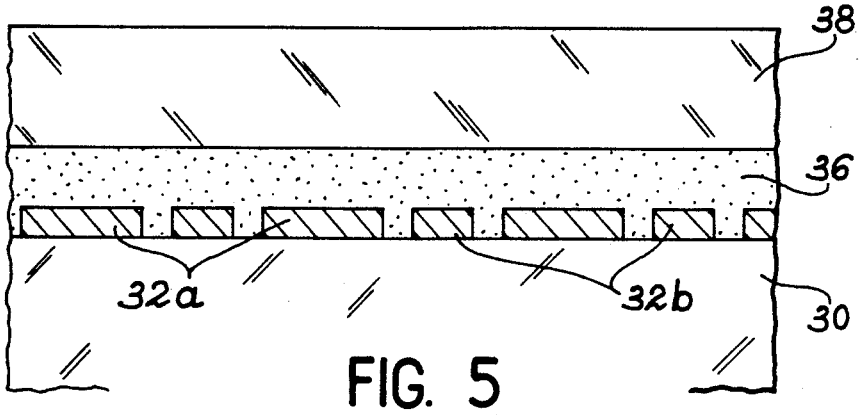

In the manner shown in FIG. 5, the electrodes are e.g. in the form of two parallel conductive strips 32*a*, 32*b* of different widths and arranged in alternating manner. In particular, these electrodes 32*a*, 32*b* can have a thickness between 100 and 150 nm. The spacing of the structure can be 0.35 $\mu$m, the strips 32*a* being 150 um wide, the strips 32*b* 100 $\mu$m wide and the zones between the conductive strips 50 $\mu$m wide.

After eliminating the resin mask 34, e.g. by dissolving in acetone in the case of a resin of the phenol formaldehyde type, the body of the structure, i.e. all the structure except the ends of the conductive strips 32*a*, 32*b* of the electrodes is covered by a dielectric material layer 36. The latter serves as a protective layer and can be made from $Ta_2O_5$, $Y_2O_3$, $Al_2O_3$, $ZrO_2$, $Si_3N_4$, $SiO_2$, $TiO_2$, etc. Preferably, said dielectric layer 36 is made from $Ta_2O_5$ with a thickness of 300 nm. It can be deposited by vacuum evaporation, cathodic sputtering or by any thin film deposition process.

The following stage of the process consists of covering the dielectric layer 36 with a layer of dielectric material 38. The latter can be inert to the agents dissolving the resins generally used as the photolithography etching mask.

The function of the dielectric layer 38 is to protect the electroluminescent material or materials used, during the different stages of producing the matrix screen. For this reason, its thickness must be greater than that of the electroluminescent layer. Preferably, layer 38 is made from a material differing from that of dielectric layer 36, so as to facilitate the stopping of subsequent etchings of layer 38. The latter can in particular be of $TiO_2$, $SiO_2$, $Al_2O_3$, $Si_3N_4$, $Ta_2O_5$, $Y_2O_3$. In the case of a dielectric layer 36 made from $Ta_2O_5$, dielectric layer 38 can be made from $Y_2O_3$. For example, layer 38 can be deposited by vacuum evaporation, cathodic sputtering or any thin film deposition procedure and has a thickness of 1200 nm.

Figure 6:
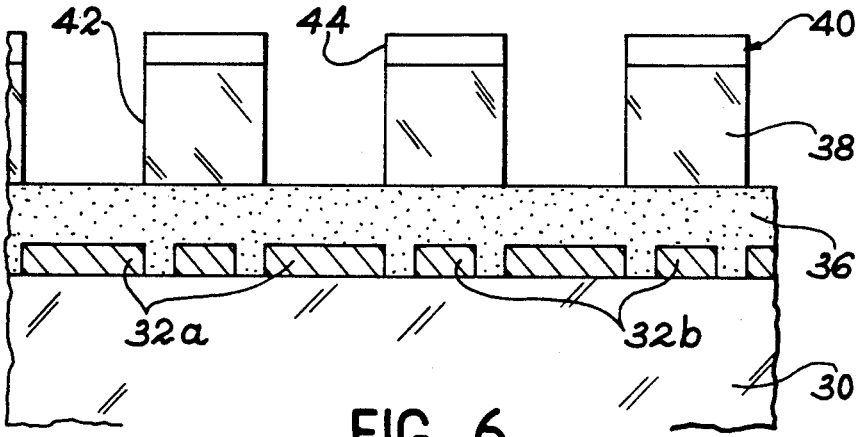

The following stage of the process shown in FIG. 6 consists of producing a resin mask 40 which includes several openings 44 and is formed on a continuous layer 38. Mask 40 is produced according to conventional photolithography processes, i.e by depositing on layer 38 a more particularly positive, photosensitive resin layer, by exposing said resin through an adapted mask and then developing said resin. This positive resin is e.g. of the phenolformaldehyde type.

The openings 44 of the mask face the conductive strips 32*a*. By using this mask the etching of the continuous layer 38 forms openings 42 in this layer 38. These openings are formed below openings 44 and consequently face the conductive strips 32*a*. Thus, its shape is dependent on the shape of the row electrodes and the column electrodes to be used in producing the matrix screen. Mask 40 has openings 44, at least one of which is provided at each intersection of an electrode of the first group and an electrode of the second group or at each intersection of a row electrode and a column electrode.

For the row and column electrodes, constituted in each case by two parallel conductive strips of different widths, such as 32*a* and 32*b*, the openings 44 in mask 40 face a first conductive strip, e.g. 32*a* of each electrode of the first group and face a first conductive strip of each electrode of the second group. The width and length of these openings are respectively equal to the widths of the conductive strips of the electrodes of the first and second crossing groups. In particular, mask 40 has openings 44 arranged, as shown in FIGS. 1 and 2, at the location of the electroluminescent zones 10.

Through mask 40 is then performed a first etching of dielectric layer 30 and specifically over the entire thickness thereof, so as to form openings 42. Etching can be carried out by the dry or wet method using an isotropic etching process (chemical etching) or an anisotropic etching process (reactive ionic etching or reverse cathodic sputtering). In the case of a $Y_2O_3$ layer 58, etching can be carried out chemically in an aqueous medium using as the etching agent a mixture of hydrochloric acid, orthophosphoric acid and acetic acid, the concentration of these acids being 0.1N. Such a solution does not etch the $Ta_2O_5$, which preferably forms the dielectric layer 36, so that the stopping of etching of layer 32 is easy to detect.

Figure 7:
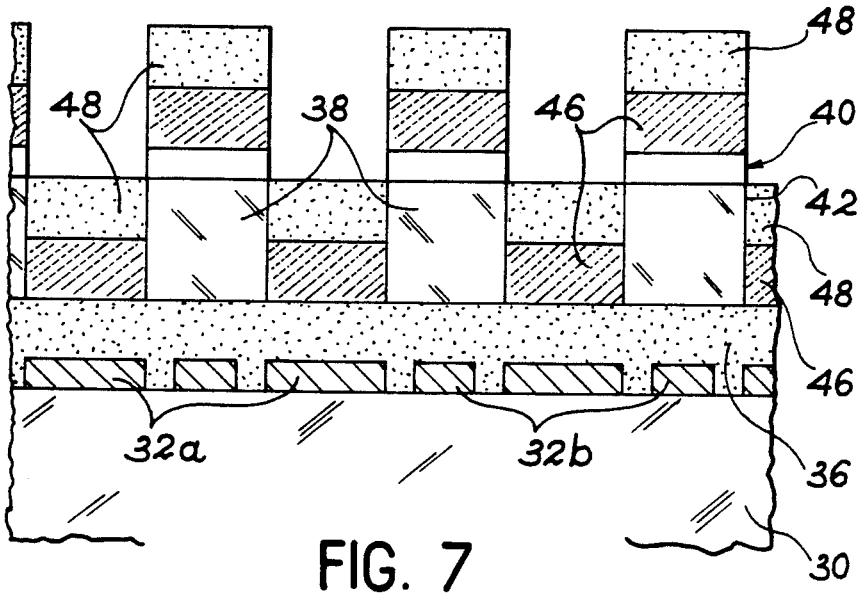

As shown in FIG. 7, the following stage of the process consists of covering the complete body of the structure (except at the ends of the electrodes) with a layer 46 of a first electroluminescent material. Layer 46 can e.g. be made from manganese-doped ZnS, $TbF_3$-doped ZnS or $CeF_3$-doped SrS. Advantageously layer 46 is made from ZnS with a 3 to 3.5 mole % manganese doping. It has a luminance of 55 cd/m$^2$. This electroluminescent layer 46, e.g. having a thickness of 800 nm, can be deposited by vacuum evaporation.

Following the deposition of electroluminescent layer 46, a layer 48 of a dielectric material is deposited thereon The function of layer 48 is to protect the electroluminescent layer 46 during the elimination of resin mask 40 and it can be made from the same material as that used for dielectric layer 36. For example, it can be made from $Ta_2O_5$, $TiO_2$, $Y_2O_3$, $Al_2O_3$, $Si_3N_4$, $ZrO_2$, $SiO_2$, etc. Preferably, layer 48 is made from tantalum oxide and has a thickness of 300 nm. The $Ta_2O_5$ layer 48 can be obtained by vacuum evaporation or cathodic sputtering.

Figure 8:
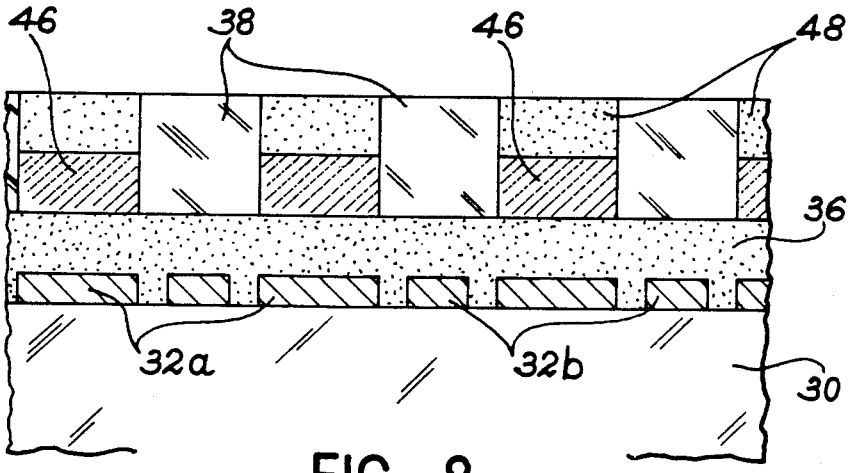

This is followed by the elimination of resin layer 40, which served as a mask for the first etching of the dielectric layer 38 using an appropriate solvent, e.g. acetone for a phenolformaldehyde resin. The elimination of resin layer 40 also makes it possible to eliminate those regions of the electroluminescent layer 46 and those regions of the dielectric layer 48 surmounting the resin layer 40. The structure obtained is shown in FIG. 8.

Figure 9:
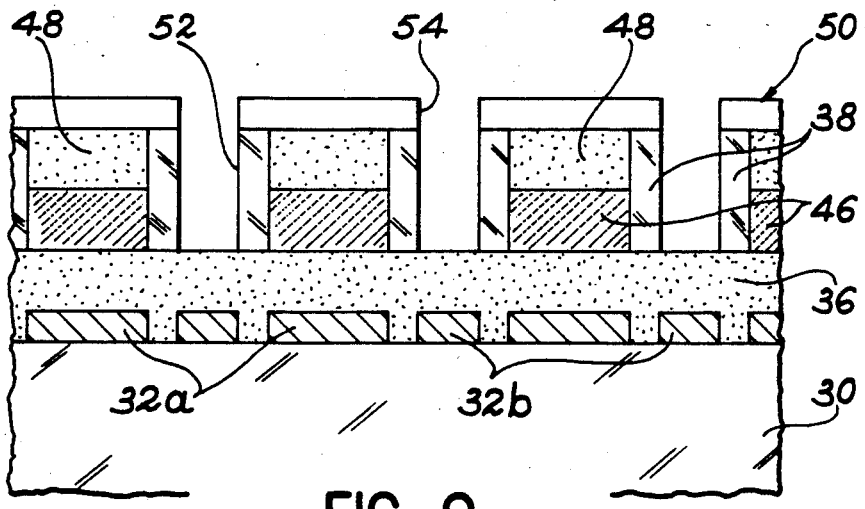

The following stage of the process consists of carrying out, by conventional photolithography processes (deposition, exposure and development), a resin mask 50, including several openings 54 as shown in FIG. 9. The shape of the openings is the same as the openings 52 which are to be formed in layer 38. These openings correspond to the openings 42 and 44 in FIG. 6. Its shape is dependent on the shape of the row electrodes and column electrodes envisaged for producing the matrix screen. Resin mask 50 is provided with openings 54, at least one opening being positioned at each intersection of an electrode of the first group and an electrode of the second group.

Openings 54 face a second conductive strip, e.g. 32*b* of each electrode of the first group and face a second conductive strip of each electrode of the second group, in the case where the electrodes are formed from two conductive strips. The dimensions of these openings are defined by the width of the conductive strips of the electrodes of the first and second groups. In particular, mask 50 can be provided with openings 54 which, as shown in FIGS. 1 and 2, are positioned at the location of the electroluminescent zones 12.

The following stage of the process consists of eliminating those regions of dielectric layer 38 not covered with resin until the dielectric layer 36 is exposed. This etching can be carried out by the dry or wet method using isotropic etching, e.g. chemical etching, or anisotropic etching, e.g. reactive ionic etching or reverse cathodic sputtering. In the case of a $Y_2O_3$ layer 38, etching can be carried out chemically using a mixture of 0.1N HCl, $H_3PO_4$ and a$CH_3COOH$, which does not etch the $Ta_2O_5$ forming dielectric layer 36.

Figure 10:
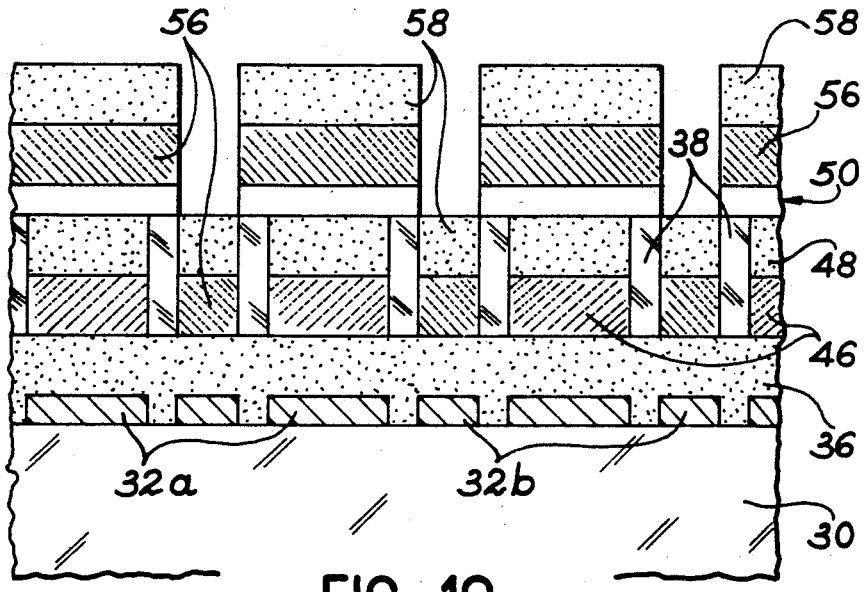

As shown in FIG. 10, the following stage of the process consists of covering the body of the structure (except at the ends of the electrodes) with a layer 56 of a second electroluminescent material. Preferably, the material forming layer 56 differs from that forming the electroluminescent layer 46, so as to obtain different electroluminescent properties, even when the same voltage is applied to the terminals of these two materials in the finished matrix screen.

In particular, the luminescence ratio $\gamma$ between the two materials can be 2.4 for the same exciting voltage. This can be obtained by using as the electroluminescent material for layer 56 manganese-doped ZnS with a 1.5 mole % manganese concentration. Like the ZnS:Mn electroluminescent layer 46, layer 56 has a thickness of 800 nm. The deposition of layer 56 can be carried out by vacuum evaporation, as hereinbefore.

Following the deposition of the electroluminescent layer 56, a layer 58 of a dielectric material is deposited thereon. The function of this layer is to protect electroluminescent layer 56 during the dissolving of resin mask 50. Dielectric material layer 58 can be made from the same or a different material to that constituting dielectric layer 48. It can in particular be produced from $Ta_2O_5$, $Y_2O_3$, $Al_2O_3$, $ZrO_2$, $Si_3N_4$, $Ti_{42}^{3}$, $SiO_2$, etc. Preferably, said layer is made from $Ta_2O_5$, like dielectric layer 48. The $Ta_2O_5$ layer can have a thickness of 300 nm and can be deposited by vacuum evaporation or cathodic sputtering.

Figure 11:
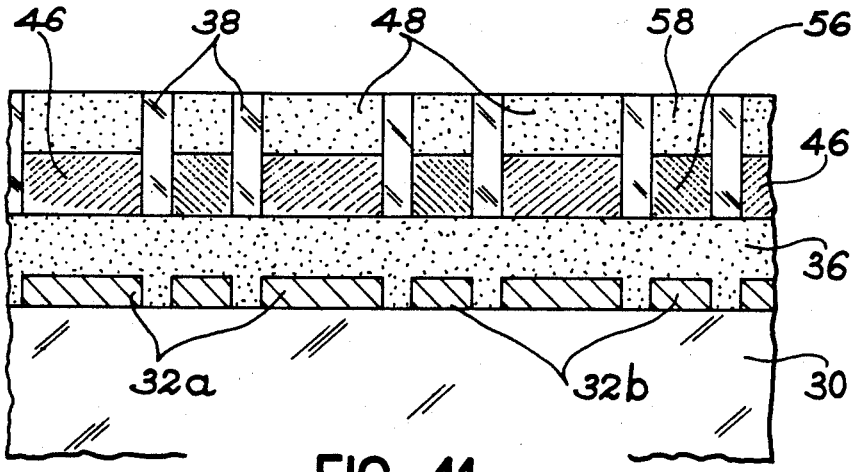

As shown in FIG. 11, the resin mask 50 used for the second etching of layer 38 is then eliminated. In the case of a mask 50 made from a resin of the phenolformaldehyde type, said elimination can be carried out with acetone. The elimination of the resin layer 50 simultaneously brings about the elimination of the regions of layers 56 and 58 surmounting said mask.

Figure 12:
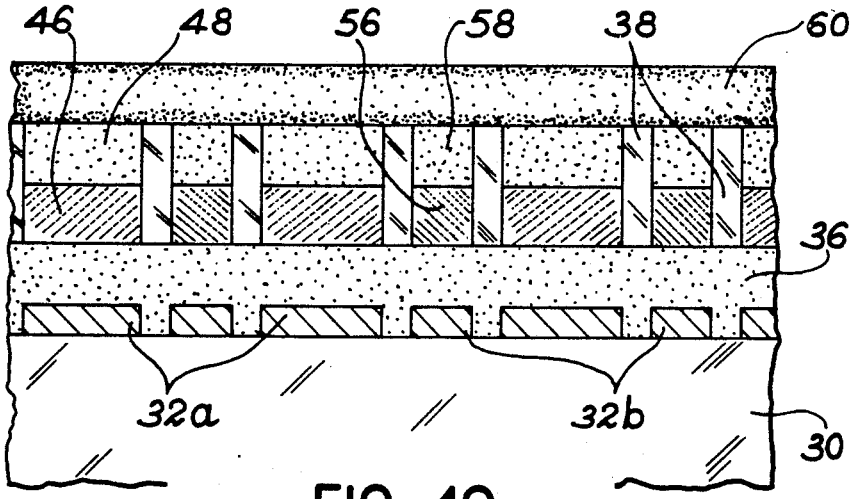

The following stage of the process consists optionally of covering the body of the structure obtained (except at the ends of the electrodes) with a dielectric material layer 60, as shown in FIG. 12. The function of layer 60 is to smooth or flatten the surface of the structure when this is considered necessary and can e.g. be made from the same material as that constituting dielectric layer 36. For example, layer 60 can be made from $Ta_2O_5$ and has a thickness of 300 nm. This layer can be deposited by vacuum evaporation or cathodic sputtering.

The following stages of the process consists of producing, by conventional photolithography processes, the second group of electrodes, which serve as row electrodes when the electrodes of the first group serve as column electrodes. These electrodes can be obtained by depositing a thin metal film on the body of the structure, e.g. by cathodic sputtering and then etching said film through an appropriate mask defining the dimensions and locations of the electrodes.

These electrodes are preferably made from aluminium and e.g. have a thickness of 100 to 150 nm. They are constituted by parallel conductive strips, the spacing the structure being equal to 0.35 $\mu$m. The structure of these electrodes can be the same or different from that of the first group.

The final structure of the thus produced electroluminescent screen is e.g. that of FIG. 1.

The production process for a matrix screen according to the invention is simple to realize, because the different stages forming it are well known to the Expert.

The above description has clearly only been given in an illustrative manner. All modifications, particularly with regards to the thickness and nature of the different materials constituting the screen can be envisaged without passing beyond the scope of the present invention. Moreover, the dielectric layers 36 and 60, which are directly in contact with the row and column electrodes can be eliminated, when the deposition procedure for layers 48 and 58 make it possible to obtain fault-free layers.

What is claimed is:

1. A matrix screen incorporating a layer of material having electroluminescent properties and placed between p parallel row electrodes and q parallel column electrodes, said row electrodes and column electrodes crossing one another, an image point $x_{ij}$ of said screen being defined by the region of the electroluminescent material covered by row electrode i and column electrode j, in which i and j are integers such that $1 \leqq i \leqq p$ and $1 \leqq j \leqq q$, wherein each row electrode is formed from m first parallel conductive strips of different widths and each column electrode is formed from n second parallel conductive strips of different widths, m and n being positive integers, whereof at least one, either m, n or both is $\geqq 2$ and wherein the material layer is formed from at least two solid materials, a first and a second material, each having different electroluminescent properties and cut over its entire thickness into several zones distributed in matrix-like manner, said zones being defined by the intersection of said first and second parallel conductive strips, wherein each zone is formed from one of at least two luminescent materials, each image point corresponding to at least two adjacent zones respectively formed from said first and said second electroluminescent materials.

2. A matrix screen according to claim 1, wherein said p row electrodes are identical.

3. A matrix screen according to claim 1, wherein said q column electrodes are identical.

4. A matrix display device with several tints incorporating a matrix screen according to claim 1, comprising means for independently applying to the conductive strips of each row electrode and each column electrode, electrical signals used for controlling on an all or nothing basis said electroluminescent properties of said electroluminescent material layer.

5. A matrix screen according to claim 1, wherein a first dielectric material is provided between said first and second electroluminescent materials.

6. A matrix screen according to claim 5, wherein a second dielectric material is provided on said first electroluminescent material and has the same configuration as that of said first electroluminescent material and wherein a third dielectric material is provided on said second electroluminescent material and has the same configuration as that of said second electroluminescent material.

7. A matrix screen according to claim 1, wherein n and m are at the most equal to 2.

8. A matrix screen according to claim 6, wherein a layer of a fourth dielectric material is provided between the column electrodes and the electroluminescent material layer.

9. A matrix screen according to claim 8, wherein a layer of a fifth dielectric material is provided between the row electrodes and said second and third dielectric materials.

* * * * *